United States Patent [19]

Hagemeister

[11] Patent Number: 4,796,872

[45] Date of Patent: Jan. 10, 1989

[54] BENT WIRE SPRING MODULE

[75] Inventor: Robert C. Hagemeister, Boston, Mass.

[73] Assignee: Webster Spring Co. Inc., Oxford, Mass.

[21] Appl. No.: 72,405

[22] Filed: Jul. 13, 1987

[51] Int. Cl.[4] ..... A47C 23/02; F16F 3/02

[52] U.S. Cl. ..... 267/103; 5/247; 5/262; 267/110

[58] Field of Search ..... 267/80, 88, 95, 96, 267/298, 103, 105, 110, 111, 112; 5/247, 255, 253, 262

[56] References Cited

U.S. PATENT DOCUMENTS

| | | | |
|---|---|---|---|
| 3,085,259 | 4/1963 | Sandor | 5/247 |
| 3,292,921 | 12/1966 | Winkler et al. | 257/110 |
| 3,653,081 | 4/1972 | Davis | 5/262 |
| 4,470,584 | 9/1984 | Mizelle | 267/103 |
| 4,577,841 | 3/1986 | Hagemeister | 5/247 X |
| 4,595,181 | 6/1986 | Hagemeister | 5/247 X |
| 4,703,527 | 11/1987 | Mizelle | 5/255 X |

*Primary Examiner*—Andres Kashnikow
*Assistant Examiner*—Richard Potosnak
*Attorney, Agent, or Firm*—Robert T. Gammons

[57] ABSTRACT

A bent wire spring module provided with spirally-formed attaching elements at its upper end for interengagement with the border wires of a grid frame.

6 Claims, 1 Drawing Sheet

BENT WIRE SPRING MODULE

BACKGROUND OF THE INVENTION

Bent wire soring modules for disposition between a base frame and a grid frame of a soring assembly at the corners have heretofore been attached to the border wire of a grid frame by wraparound clips or by a length of spirally-wound wire as shown, for example, in U.S. Pat. No. 4,452,438. The added attaching elements require additional manufacturing operations both to construct them for application and for using them to anchor the spring modules to the border wire of the grid frame. It is the purpose of this invention to eliminate these extra structural elements and the operations for applying the same which add to the total cost of manufacture by incorporating the anchoring structure as an integral part of the spring module itself.

SUMMARY OF THE INVENTION

A bent wire spring module structured to be disposed at the corner of a spring assembly to support the grid frame above the base frame characterized in that the upper ends of the spring module are interengageably attached to the border wire of the grid frame without the aid of clips by spirally-wound lengths of wire formed integral with the upper ends of the module disposed about the border wire of the grid frame.

More specifically, the soring modules structured according to the invention for supporting the grid frame above the base frame at the corner are provided with means at their upper ends for attachment to the border wire in the form of spiral lengths of wire disposed in a generally horizontal plane for helical interengagement with the border wire at the corner. As illustrated, each module comprises at its upper end right-angularly disposed lengths of wire formed into helical spirals for disposition about the border wire. The helical lengths of wire are connected to the upper ends of the right-angularly disposed, upwardly-inclined lengths of wire by lateral extensions which underlie and support the border wire. The lower ends of the upwardly-inclined lengths of wire are connected with the upper ends of spaced, parallel, vertical lengths of wire and the lower ends of the vertical lengths of wire are connected to the upper ends of downwardly-inclined, right-angularly disposed lower lengths of wire which form the lower inclined legs of the spring module.

The invention will now be described in greater detail with reference to the accompanying drawings, wherein.

Figure 3:
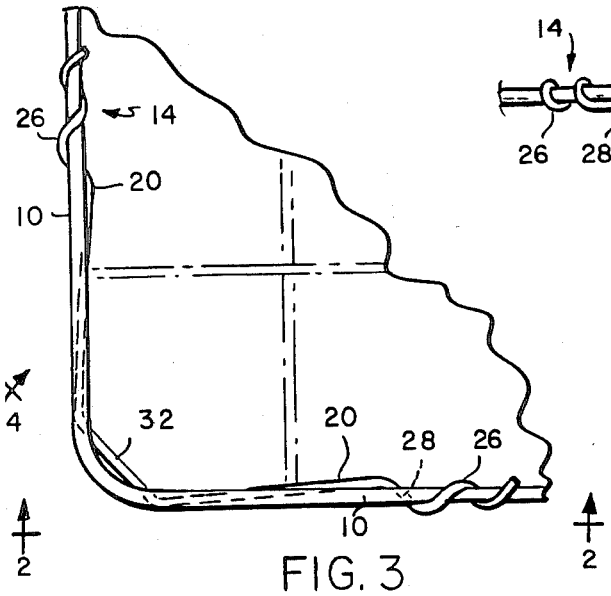
FIG. 3 is a fragmentary plan view showing the attachment of the upper end of the spring module to the grid frame.
Figure 4:
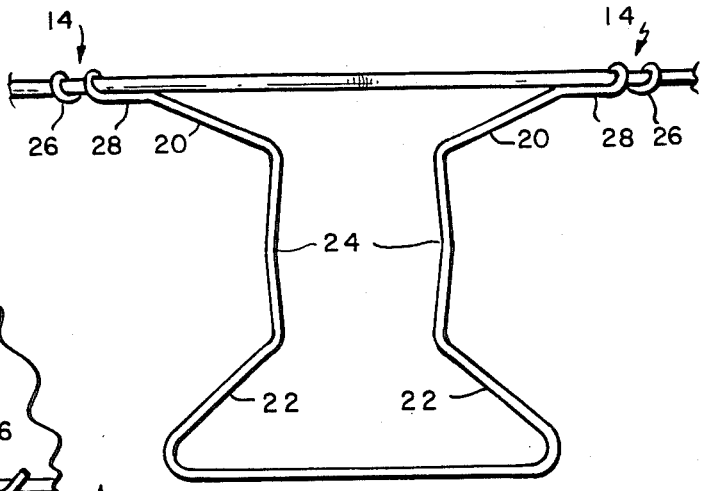
Figure 5:
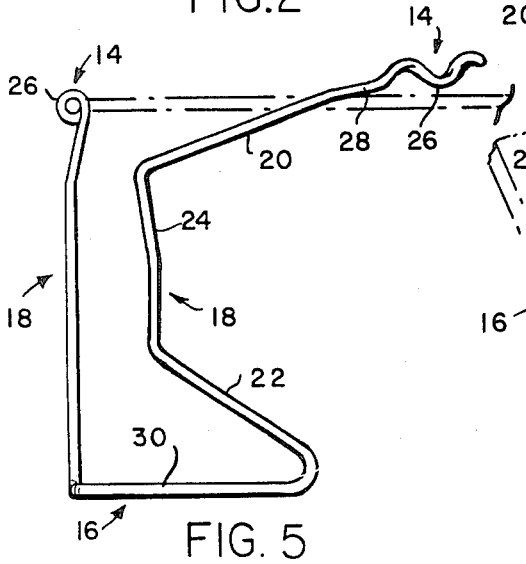

FIG. 4 is an elevation at the corner of the spring assembly showing the attachment of the upper and lower ends of the spring module to the grid frame and base frame, respectively and the lateral extensions connecting the upper ends of the legs to the helical attaching means; and FIG. 5 is an elevation of a spring module structured according to this invention prior to installation between the grid frame and base frame.

Figure 2:
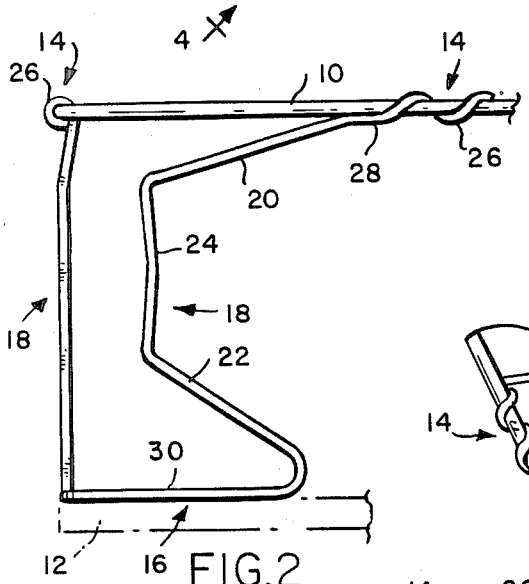
FIG. 2 is an elevation parallel to one side showing the spring module attached at its upper and lower ends to the grid frame and base frame, respectively.
Figure 1:
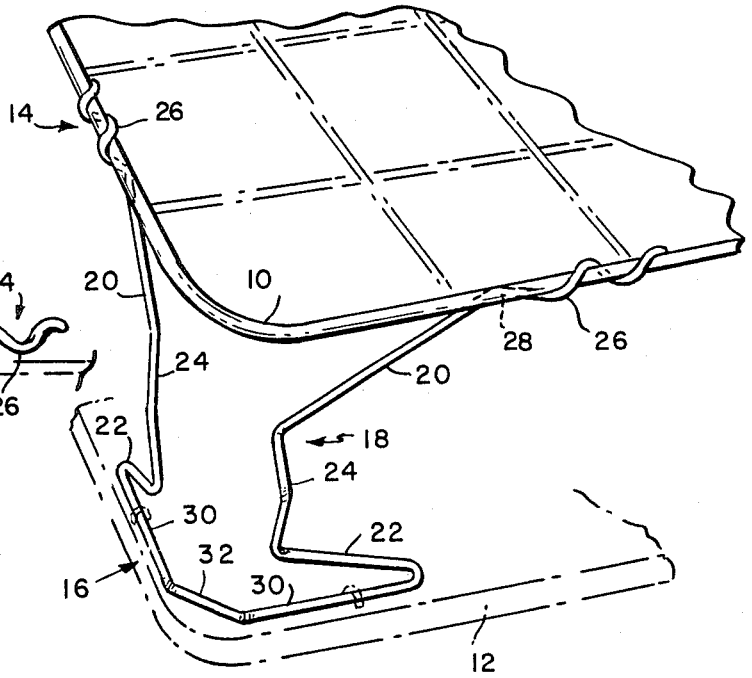
FIG. 1 is a perspective at the corner of a spring assembly showing the spring module of the instant application attached at its upper and lower ends to the grid frame and base frame, respectively.

Referring to FIGS. 1 and 2, the spring module structured according to this invention is disposed between a grid frame 10 and a base frame 12 and comprises upper attaching means 14, lower attaching means 16 and intervening legs 18—18.

Referring to FIGS. 1 and 2, the legs 18—18 are of generally U-shaped configuration comprising upper inclined lengths 20—20, lower inclined lengths 22—22 and vertical lengths 24—24. The legs 18—18 are disposed in vertical planes situated at right angles to each other. The upper attaching means 14 at the upper ends of the upper legs 20—20 are helical lengths of wire 26—26 which form extensions of the upper ends of the upper legs 20—20, FIG. 5. The lower ends of the lower legs 22—22 are integrally connected to the lower attaching means 16 which comprise right-angularly disposed lengths of wire 30—30 disposed in the planes of the diverging lengths of wire forming the legs and a diagonal length of wire 32 joining the same.

The structure as thus described and as shown in FIGS. 1 and 2 is disposed at the corner of the spring assembly between the grid frame 10 and the base frame 12 with the legs 18—18 paralleling the border wires 10 at the corner, with the upper and lower inclined legs 20—20 and 22—22 extending away from the corner at right angles to each other, with the helical portions 26—26 disposed about the border wire 10 and with the right-angularly disposed lengths of wire 30—30 at the lower end of the module stapled to the base frame 12. Desirably, the helical lengths of wire 26—26 make at least two turns about the border wire 10, although the number of turns can be varied to suit the particular requirements for firm anchoring.

It is to be observed, FIG. 5, that the helical lengths of wire 26—26 at the upper ends of the upwardly-inclined legs 20—20 are connected to the upper ends of the legs by lateral extensions 28—28 so that when the modules are secured between the grid frame and the base frame, the extensions 28—28 underlie the border wire and thus provide horizontal bearing surfaces for the border wire. The extensions 28—28 are initially inclined upwardly relative to the upper ends of the legs 20—20, as shown in FIG. 5, so that when the modules are disposed between the base frame and the grid frame, the lateral extensions 28—28 are depressed, that is, flexed downwardly, thus firmly locking the extensions 28—28 against the underside of the grid frame.

As thus structured, the modules can be easily assembled to the grid frame without the aid of tools and without the use of attaching devices such as clips and the like.

It should be understood that the present disclosure is for the purpose of illustration only and includes all modifications or improvements which fall within the scope of the appended claims.

What is claimed is:

1. A bent wire spring module for disposition between a rigid, rectangular base frame comprising spaced, parallel sides and ends and a wire grid frame comprising a rectangular border wire and transversely and longitudinally-crossing grid wires attached at their ends to the border wire and bent wire spring modules at each corner of the base frame and the grid frame, each comprising a unitary length of wire embodying right-angularly disposed lower and upper attaching means and a pair of vertical supports disposed therebetween, said lower attaching means comprising integrally-connected first lengths of wire disposed at substantially right angles to each other and substantially parallel to the respective sides at the corners of the base frame for attachment thereto, said upper attaching means comprising integrally-connected second lengths of wire of helical configuration at substantially right angles to each other each disposed helically about and substantially parallel to respective sides of the border wire at a corner of the grid frame for attachment thereto, each vertical support comprising lower and upper legs, said lower legs being connected at their lower ends to the lower attaching means, means comprising lateral extensions at the upper ends of the upper legs disposed at an angle thereto such as to abut the underside of the border wire, said lateral extensions being connected at one end to the upper ends of the upper legs and at the other ends to the helical lengths of wire and said lower and upper legs at their upper and lower ends respectively being connected to each other.

2. A bent wire spring module according to claim 1 wherein the upper legs are longer than the lower legs.

3. A bent wire spring module according to claim 1 wherein the lower and upper legs diverge with respect to each other.

4. A bent wire spring module according to claim 1 wherein the lower and upper ends of the legs are connected by vertical lengths of wire.

5. A bent wire spring module according to claim 4 wherein the vertical lengths of wire contain deviations.

6. A bent wire spring module according to claim 4 wherein the lower and upper legs and the vertical lengths of wire connecting the same are disposed in planes perpendicular to the base frame and grid frame.

* * * * *

UNITED STATES PATENT AND TRADEMARK OFFICE

CERTIFICATE OF CORRECTION

PATENT NO. : 4,796,872

DATED : January 10, 1989

INVENTOR(S) : Robert C. Hagemeister

It is certified that error appears in the above-identified patent and that said Letters Patent is hereby corrected as shown below:

Column 1, line 6, change "soring" to --spring--

Column 1, line 7, change "soring" to --spring--

Column 1, line 30, change "soring" to --spring--

Signed and Sealed this

Fifth Day of September, 1989

*Attest:*

*Attesting Officer*

DONALD J. QUIGG

*Commissioner of Patents and Trademarks*